United States Patent [19]

Devlin

[11] 4,107,857

[45] Aug. 22, 1978

[54] ATHLETIC SHOE CONSTRUCTION

[76] Inventor: Gerard P. Devlin, 1028 Adams Ave., Franklin Square, N.Y. 11010

[21] Appl. No.: 786,176

[22] Filed: Apr. 11, 1977

[51] Int. Cl.[2] ..... A43B 5/00; A43B 3/12; A43B 23/26; A43C 15/00

[52] U.S. Cl. ..... 36/129; 36/11.5; 36/67 D; 36/54

[58] Field of Search ..... 36/11.5, 59 R, 67 R, 36/67 D, 129, 50, 54, 134

[56] References Cited

U.S. PATENT DOCUMENTS

| | | | |
|---|---|---|---|
| 2,220,534 | 11/1940 | McLean | 36/11.5 |
| 2,469,708 | 5/1949 | Alexender | 36/11.5 |
| 2,588,061 | 3/1952 | Vesely | 36/11.5 |
| 3,352,034 | 11/1967 | Braun | 36/67 D |
| 3,577,663 | 5/1971 | Mershon | 36/67 D |
| 3,597,863 | 8/1971 | Austin | 36/59 R |

*Primary Examiner*—Patrick D. Lawson
*Attorney, Agent, or Firm*—Allison C. Collard

[57] ABSTRACT

An athletic shoe includes a sole having toe, ball, arch and heel sections, corresponding to that of a foot and an upper secured to the sole, which includes two pairs of upwardly-tapered straps secured to the sole on opposite sides of its ball and arch sections, respectively, which provide improved support for the wearer's foot and which permits the accommodation of a relatively wide range of foot sizes. In addition, the shoe includes a unique, removable spike assembly which facilitates quick and easy mounting and removal of the spikes. The shoe is especially adapted for use as a competition track shoe.

13 Claims, 5 Drawing Figures

FIG. 3
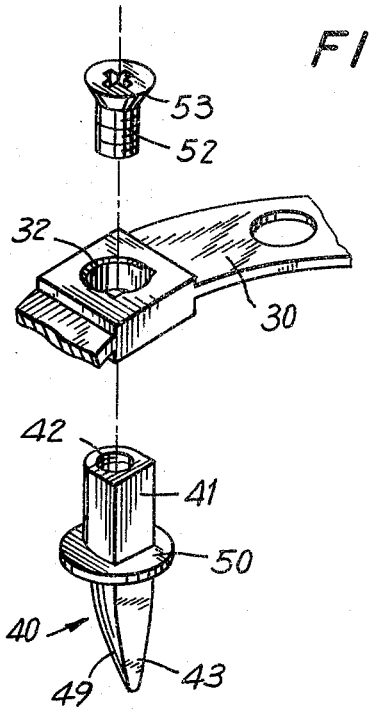
FIG. 5
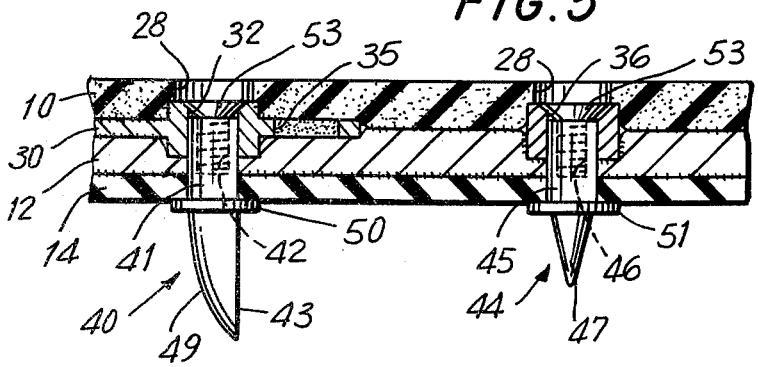
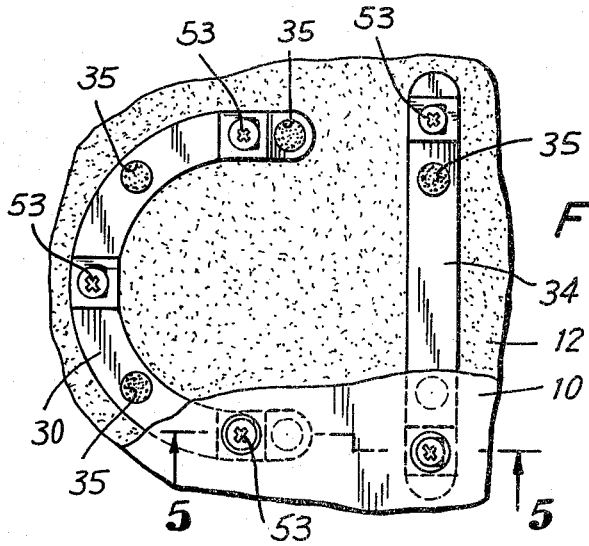
FIG. 4

ATHLETIC SHOE CONSTRUCTION

This invention relates to an athletic shoe and, more particularly, to a competition track shoe.

A wide variety of athletic shoes and, in particular, track shoes, are presently used for both indoor and outdoor track meets. While these shoes are usually satisfactory, they generally have been found to have certain drawbacks. In particular, they typically do not afford adequate foot support at crucial points, i.e., the ball and arch of the foot. In addition, they generally do not accommodate a wide range of foot sizes.

Moreover, when the track shoes are constructed with spikes (for better adhesion on tracks), the spikes are either molded in the sole, which prevents their use on certain tracks, or they are removably secured to the sole by means of nuts or (internally threaded) cups embedded in the sole of the shoe in which the spikes are threadably received. In this latter construction, the spikes are installed and locked in place, as well as removed, by means of a spike wrench which is designed to engage flat spots formed on the sides of the spikes. However, when the spikes become the least bit worn, considerable difficulty is incurred in effecting their removal with the wrench, due to slipping, etc. This often necessitates the use of pliers, or even a bench vise to effect their removal, a most cumbersome and tiresome procedure.

Accordingly, it is an object of the present invention to provide an improved athletic shoe which afford increased support for the wearer's foot, especially at the ball and arch thereof.

It is also an object of this invention to provide an improved athletic shoe which accommodates a wide range of foot sizes.

It is a further object of this invention to provide an improved athletic shoe, having removable spikes which may be readily and facilely installed and removed.

It is a more particular object of this invention to provide such an improved athletic shoe, having the foregoing attributes and characteristics which is especially suited for competitive use at both indoor and outdoor track meets.

Certain of the foregoing and related objects are readily attained in an athletic shoe, which includes a sole having toe, ball, arch and heel sections corresponding to the toe, ball, arch and heel of a foot, and an upper including a toe cup secured generally to the periphery of the sole adjacent to the toe section thereof, a tongue secured to the toe cup and extending generally rearwardly therefrom toward the heel section of the sole. The upper also includes at least two pairs of generally upwardly-extending straps, one pair of which is disposed adjacent to the ball section of the sole, and the other pair of which is disposed adjacent to the arch section of the foot, with the straps of each pair disposed opposite one another on opposite sides of the respective sole sections. Each of the straps of each pair has a lower end which is secured to the sole and an upper end which overlaps the other strap of the pair to permit their fastening to one another.

Preferably, the upper additionally includes a heel cup secured generally to the periphery of the sole adjacent to the heel section thereof, and a third pair of generally upwardly-extending straps, the straps of which are disposed opposite one another on opposite sides of the heel section of the sole. Each of the straps has a lower end secured to the heel cup and an upper end which overlaps the other strap of the pair to permit their fastening to one another. Most desirably, the tongue has three pairs of spaced-apart, parallel slots formed therein adjacent to the ball, arch and heel sections of the sole, respectively, through which the respective pairs of straps may be inserted to effect fastening thereof. Most advantageously, the straps of each of the pairs are upwardly tapered.

In a preferred embodiment of the invention, the shoe additionally includes a removable spike assembly which advantageously comprises at least one spike mount embedded in the sole, which spike mount has at least one vertically-extending bore formed therethrough, at least one removable spike having an upper end which is insertable within the bore of the spike mount and which has formed therein an upwardly-opening, axially-extending, internally-threaded bore, and at least one removable screw, having an expanded head portion, which is insertable in the bore of the mount with the head thereof abutting the mount, and which is threadably receivable within the bore of the spike to effect locking of the spike to the sole.

In a particularly preferred embodiment, the "at least one" spike mount has a generally flat, semi-circular configuration and is embedded in the sole adjacent to the toe section thereof, and has at least three, spaced-apart, vertically-extending bores formed therethrough. Most desirably, the assembly includes a second spike mount having a generally flat, bar-shaped configuration which is embedded in the sole adjacent to the ball section of the foot and which extends traversely thereacross. The second spike mount has at least two, spaced-apart, vertically-extending bores formed therethrough, and the assembly includes at least five of the aforementioned spikes and screws, to accommodate the five bores provided by these two spike mounts. Each of the spike mounts preferably has at least one hole formed therethrough, which facilitates embedding and positive securement of the mounts in the sole and, most desirably, the shoe upper has three holes formed therethrough, vertically aligned with the bores of the "at least one" spike mount, to permit access to the screws received therein. It is desirable that the bores of the spike mounts have a generally semi-circular configuration and the upper ends of the spikes have a corresponding configuration to permit insertion therein, and also that the spikes have a radially, outwardly-extending collar which abuts the bottom of the sole, when the spike is fully inserted in the spike mount. It is furthermore advantageous that at least one of the spikes has an arcuately-curved, forward portion and a flat, rearward portion below the collar thereof.

Other objects and features of the present invention will become apparent from the following detailed description considered in connection with the accompanying drawing which discloses the embodiments of the invention. It is to be understood, however, that the drawing is designed for the purpose of illustration only and not as a definition of the limits of the invention.

In the drawing, wherein similar reference characters denote similar elements throughout the several views.

FIG. 3 is a fragmentarily-illustrated, exploded, perspective view of a spike assembly employed in the shoe shown in the foregoing figures.

FIG. 4 is a fragmentarily-illustrated, elevational plan view of the shoe, taken along line 4 of FIG. 1, with portions broken away to show internal construction.

FIG. 5 is a sectional view taken along line 5—5 of FIG. 4.

Figures 1, 2:
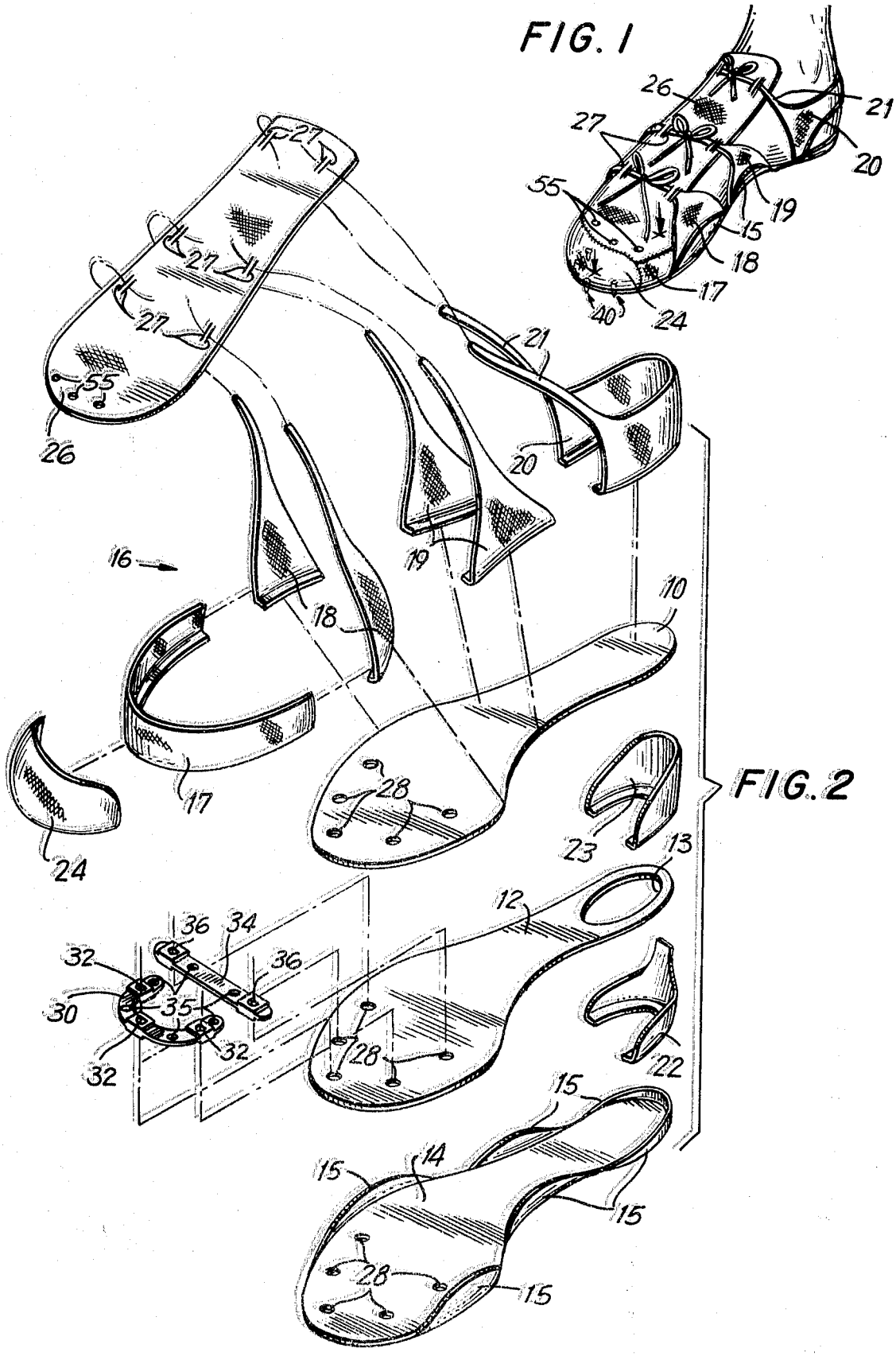
FIG. 1 is a perspective view of a track shoe embodying the present invention.
FIG. 2 is an exploded, enlarged perspective view of the track shoe illustrated in FIG. 1.

Turning now in detail to the appended drawing, therein illustrated is a novel track shoe embodying the present invention. As can be seen more clearly in FIG. 2, the shoe includes an inner sole 10, an intermediate sole 12 and an outer sole 14, which are secured or bonded together by any suitable means, such as an adhesive. Intermediate sole 12 has an opening 13 formed in its heel section to accommodate additionally padding (not shown), which opening and padding may also be provided in inner sole 10 as well. Outer sole 14 which is preferably fabricated from rubber and includes a transversely grooved or ribbed lower surface (not shown) to enhance traction, is provided with upturned edges 15 adjacent to the ball, arch, and heel sections thereof, which serve to reduce or prevent wear to the shoe upper, generally designated by the numeral 16, which is secured to soles 10, 12 and 14.

Shoe upper 16, which is preferably fabricated from lightweight leather, reinforced nylon or Velour, includes a toe cup or pocket 17, disposed generally about the periphery of the toe section of the soles, a first pair of upwardly tapered straps 18, which are disposed adjacent to the ball section of the soles opposing one another along opposite lateral edges of the soles, and a second pair of upwardly tapered straps 19 similarly disposed adjacent to the arch section of the soles. Shoe upper 16 also includes an inner heel cup 20, having a pair of oppositely-disposed straps 21 extending generally upwardly from the sides thereof, an outer heel cup 22, and a molded Fiberglas reinforcing heel cup support 23, disposed between inner and outer heel cups 20, 22, each of which is disposed about the periphery of the heel section of the soles; the outer and inner heel cups 20, 22 with reinforcing cup support 23, disposed therebetween preferably being secured together to provide an integral heel assembly. Toe cup 17 is also provided with a reinforcing toe guard 24, which is secured to its front face to reduce wear. Each of the aforementioned elements of the shoe upper 16 is provided with an inwardly-turned lower edge to facilitate their securement either between inner and intermediate soles 10, 12 or between the intermediate and outer soles 12, 14.

Secured to the upper edge of toe pocket 17 is a tongue 26 which extends rearwardly therefrom toward the heel section of the shoe and which is preferably provided with foam rubber padding on the underside (not shown), to prevent chaffing and abrasion. While tongue 26 may be formed integrally with toe pocket 17, it is preferred that they be made of two separate pieces in order to achieve a "mocassin effect". Tongue 26 includes three pairs of spaced-apart, parallel double slots 27, each pair of which is generally aligned with the pairs of straps 18, 19 and 21, respectively, to permit the straps to be threaded therethrough and be tied together (as shown in FIG. 1); the passing of the straps 18, 19 and 21 through the slots preventing slippage thereof. Due to the location of straps 18 and 19 and their rather wide, lower end portions, maximum support for the foot will be provided at the ball and arch sections thereof; the heel cup straps 21 surrounding the foot just below the ankle. In addition, fabrication of the straps from a relatively non-stretchable material, such as reinforced nylon, ensures that even after long and repeated use, maximum support will be maintained for those crucial foot areas, i.e., the ball and arch of the foot. It should also be pointed out that by utilizing this shoe construction, a relatively wide range of foot sizes (or widths) may be accommodated with a single model; the permissible outwardly bulging of straps 18, 19 accommodating larger foot widths.

Each of the soles 10, 12, 14 is provided with five holes 28, three of which are spaced about the periphery of the toe section and two of which are disposed on opposite sides of the ball section, and which are vertically aligned with the holes of the other soles. A first spike mount 30 having a generally flat, semi-circular configuration and including three, spaced-apart, semi-circular or "half-round" bores 32, extending vertically therethrough, is mounted or embedded between inner sole 10 and intermediate sole 12 with its bores 32 aligned with the three holes 28 disposed about the periphery of the toe section of the soles. Similarly, a second spike mount 34 having a generally flat, bar-shaped configuration and including two semi-circular, spaced-apart bores 36 extending vertically therethrough, is mounted between inner sole 10 and intermediate sole 12, such that bores 36 are each aligned with one of the two holes formed in the ball section of the soles. Each of spike mounts 30, 34 includes a plurality of glue or adhesive-receiving holes 35, which facilitate the secure mounting or embedment of the mounts between inner and intermediate soles 10, 12 (note FIG. 4).

As can be seen more clearly in FIGS. 3 and 5, two sets of removable spikes, generally designated by the numerals 40, 44, respectively (only one spike of each set of which is illustrated), are inserted from below outer sole 14 into the respective bores 32, 36 of spike mounts 30, 34. Each spike 40, 44 is provided with an upper end 41, 45 having a generally semi-circular cross-section, which corresponds to the cross-section of bores 32, 36 to permit their insertion therein and which is also provided with an upwardly-opening, internally-threaded, axially-extending bore 42, 46; the semi-circular configuration of the upper ends 41, 45 of spikes 40, 44 and the bores 32, 36, preventing turning or twisting of spikes 40, 44 when locked in place. Each of spikes 40, 44 has a generally radially, outwardly-extending, annular collar 50, 51 disposed beneath their upper ends 41, 45, which abuts the outer surface of outer sole 14 when the spike is fully inserted in the bore of the spike mount. The lower end of spike 40 has an arcuately-curved forward surface 49 and a flat, rearward surface 43, the former of which serves to increase the effective "contact" area with the track surface and the latter of which serves to increase the effective "push-off" area of the spikes. The lower end 47 of spike 44 is illustrated as having a conical or pin-type of configuration which is used for asphalt or board tracks. As can be appreciated, either of the spikes or a combination thereof may be employed. Typically, however, spikes 40 will be used in conjunction with spike mount 30 in order to achieve the maximum forward thrust (the toe section of the shoe being the last section to leave the ground) and the spikes 44 will be used in conjunction with spike mount 34 to prevent any possibility of slippage on a wet track.

The spikes 40, 44 are locked into the spike mounts by means of screws 52, having an enlarged head portion 53, which are inserted from above the inner sole 10 into bores 32, 36 of spike mounts 30, 34. The screws 52 are screwed into internally-threaded bores 42, 46 of spikes 40, 44 until their head portions 53 abut the upper surface of spike mounts 30, 34. The spikes are thereby locked in place. To facilitate insertion of screws 52 into spikes 40 of spike mount 30, three holes 55 are formed in toe pocket 17 or tongue 26 of upper 16, each of which is to be vertically aligned with one of the bores 32 of spike mount 30. In this manner, a screw driver or other suitable implement may be easily inserted into the holes to effect tightening or loosening of the screws 52 and, in turn, locking or removal of spikes 40. It should be pointed out that since locking of the spikes in place is effected by a locking member (i.e., a screw) disposed internally of the outer sole, even after the spikes become worn, they may still be easily removed, since the locking members themselves are not subjected to abuse or wear.

While the instant invention has been described in relation to the illustrated and preferred embodiment, it should be understood that modifications may be made as will be apparent to those skilled in the art. For instance, although the shoe upper has been shown as consisting of separate elements, they may be sewn together or be formed as an integral unit. Similarly, although the spike mounts were shown as separate elements, they also may be formed as an integral unit or, alternately, be divided into smaller spike mounts, each of which would include a single spike-and-screw-receiving bore. In addition, although a separate inner and intermediate sole were illustrated, they could be provided as a single, integral, molded inner sole with the spike mount embedded therein, or secured between the thus integrally-formed inner sole and the outer sole. It should also be noted that the number of spikes employed may be varied. Finally, the various components of the shoe may be fabricated from a wide range of materials well known in the art.

What is claimed is:

1. An athletic shoe comprising:

a flexible sole having toe, ball, arch and heel sections corresponding to the toe, ball, arch and heel of a foot; and an upper including a toe cup secured generally to the periphery of the sole adjacent to said toe section thereof, a tongue secured to said toe cup and extending generally rearwardly therefrom toward said heel section of said sole, at least two pairs of generally upwardly-extending straps, one pair of which is disposed adjacent to said ball section of said sole, and the other pair of which is disposed adjacent to said arch section of said foot, with the straps of each pair disposed opposite one another on opposite sides of the respective sole sections, each of said straps of each pair being made of a flexible, relatively non-stretchable material and having a relatively wide, lower end portion which is secured to said sole and a relatively narrow upper end portion which overlaps the other strap of said pair to permit the straps of each pair to be individually fastened directly together, said wide lower end portions providing maximum support for the foot at the ball and arch thereof and said individual fastening of said straps of each pair permitting individual adjustment of the support provided by said straps at the ball and arch sections of said sole, said upper additionally including a heel cup secured generally to the periphery of the sole adjacent to said heel section thereof, and a third pair of generally upwardly-extending straps, the straps of which are disposed opposite one another on opposite sides of the heel section of said sole, each of said straps having a lower end secured to said heel cup and an upper end which overlaps the other strap of said pair to permit their fastening to one another.

2. The athletic shoe according to claim 1, wherein said tongue has three pairs of spaced-apart, parallel slots formed therein adjacent to the ball, arch and heel sections of said sole, respectively, through which the respective pairs of straps may be inserted to effect fastening thereof.

3. The athletic shoe according to claim 1, wherein the straps of each of said pairs are upwardly tapered from said lower end portion to said upper end portion thereof.

4. The athletic shoe according to claim 1, additionally including a removable spike assembly.

5. The athletic shoe according to claim 4, wherein said removable spike assembly comprises at least one spike mount embedded in said sole, said spike mount having at least one vertically-extending bore formed therethrough, at least one removable spike having an upper end which is insertable within said bore of said spike mount and which has formed therein an upwardly-opening, axially-extending, internally-threaded bore, and at least one removable screw, having an expanded head portion, which is insertable in said bore of said mount with said head thereof abutting said mount, and which is threadably receivable within said bore of said spike to effect locking of said spike to said sole in a rigid and fixed position.

6. The athletic shoe according to claim 5, wherein said at least one spike mount has a generally flat, semicircular configuration and is embedded in said sole adjacent to said toe section thereof, said spike mount having at least three, spaced-apart, vertically-extending bores formed therethrough, wherein said assembly includes a second spike mount having a generally flat, bar-shaped configuration which is embedded in said sole adjacent to said ball section thereof and extending transversely thereacross, which has at least two, spaced-apart, vertically-extending bores formed therethrough, and wherein said assembly includes at least five of said spikes and screws.

7. The athletic shoe according to claim 6, wherein each of said spike mounts has at least one hole formed therethrough, which facilitates embedding and positive securement of said mounts in said sole.

8. The athletic shoe according to claim 7, wherein said upper has three holes formed therethrough, vertically aligned with the bores of said at least one spike mount, to permit access to said screws received therein.

9. The athletic shoe according to claim 8, wherein said bores of said spike mounts have a generally semicircular configuration and said upper ends of said spikes have a corresponding configuration to permit insertion therein, and wherein said spikes have a radially, outwardly-extending, annular collar which abuts the bottom of said sole when said spike is fully inserted in said spike mount.

10. The athletic shoe according to claim 9, wherein at least one of said spikes has an arcuately-curved, forward portion and a flat, rearward portion below said collar thereof.

11. An athletic shoe comprising:

a sole having toe, ball, arch, and heel sections, corresponding to the toe, ball, arch, and heel of a foot;

an upper including a toe cup secured generally to the periphery of said sole adjacent to said toe section thereof, a tongue secured to said top cup and extending generally rearwardly therefrom toward said heel section of said sole, and a heel cup secured generally to the periphery of the sole adjacent to said heel section of said sole, said upper also having three holes formed therethrough adjacent to said toe section of said sole;

a removable spike assembly, said spike assembly including at least one spike mount means embedded in said sole, adjacent to said toe section thereof, said spike mount means having at least one hole formed therethrough, which facilitates embedding and positive securement of said spike mount means in said sole, said spike mount means having at least three vertically-extending bores formed therethrough, at least three removable spikes, each of which has an upper portion which is insertable within one of said bores of said spike mount means, and which has formed therein an upwardly-opening, axially-extending, internally-threaded bore, and at least three removble screws, each of which has an expanded head portion, and which is insertable in one of the bores of said spike mount means with said head thereof abutting said spike mount means, and which is threadably receivable within said bore of one of said spikes to effect locking engagement of said spikes to said sole in a rigid and fixed, non-displaceable position, said holes in said upper each being vertically-aligned with one of the bores of said spike mount means to permit access to said screws received therein, and said spikes each having a radially, outwardly-extending annular collar which abuts the bottom of said sole, when said spikes are fully inserted in said spike mount means, said spikes, each having an arcuately-curved, forward portion, and a flat, rearward portion below said collar thereof.

12. An athletic shoe according to claim 11, wherein said spike mount means comprises a single spike mount having a generally flat, semi-circular configuration which is embedded in said sole adjacent to said toe section thereof, said spike mount having at least three, spaced-apart, vertically-extending bores formed therethrough, wherein said assembly includes a second spike mount having a generally flat, bar-shaped configuration which is embedded in said sole adjacent to said ball section thereof and extending transversely thereacross, which has at least two, spaced-apart, vertically-extending bores formed therethrough, and wherein said assembly additionally includes two spikes, each of which has an upper end which is insertable within one of the bores of said second spike mount and which has formed therein an upwardly-opening, axially-extending, internally-threaded bore, and at least two removable screws, each of which has an expanded head portion and which is insertable in one of the bores of said second mount with said head thereof abutting said mount, and which is threadably receivable within one of said bores of said spikes to effect locking engagement of said spike to said sole in rigid and fixed, non-displaceable position, each of said spikes having a radially, outwardly-extending annular collar which abuts the bottom of the sole, when said spike is fully inserted in said spike mount.

13. An athletic shoe according to claim 12, wherein said bores of said spike mounts have a generally semi-circular configuration and said upper ends of said spikes have a corresponding configuration to permit insertion therein.

* * * * *